US006673007B2

(12) United States Patent
Salmon et al.

(10) Patent No.: US 6,673,007 B2
(45) Date of Patent: Jan. 6, 2004

(54) RADIANT WARMER

(75) Inventors: Andrew Paul Maxwell Salmon, Auckland (NZ); Matthew Jon Payton, Auckland (NZ)

(73) Assignee: Fisher & Paykel Healthcare Limited, Auckland (NZ)

( * ) Notice: Subject to any disclaimer, the term of this patent is extended or adjusted under 35 U.S.C. 154(b) by 0 days.

(21) Appl. No.: 10/287,090

(22) Filed: Nov. 4, 2002

(65) Prior Publication Data

US 2003/0055310 A1 Mar. 20, 2003

Related U.S. Application Data

(62) Division of application No. 09/802,251, filed on Mar. 8, 2001.

(30) Foreign Application Priority Data

Mar. 8, 2000 (NZ) ..... 503265

(51) Int. Cl.[7] ..... A61G 11/00
(52) U.S. Cl. ..... 600/22
(58) Field of Search ..... 600/22; 5/421; 237/69

(56) References Cited

U.S. PATENT DOCUMENTS

| | | | | |
|---|---|---|---|---|
| 2,621,279 A | | 12/1952 | Richardson | |
| 3,338,233 A | | 8/1967 | Grosholz et al. | |
| 3,698,397 A | * | 10/1972 | Franzel | 607/96 |
| 3,705,576 A | * | 12/1972 | Roth | 600/22 |
| 3,858,570 A | | 1/1975 | Beld et al.. | |
| 3,898,427 A | | 8/1975 | Levin et al. | |
| 3,919,999 A | * | 11/1975 | Gluck et al. | 600/22 |
| 3,992,212 A | | 11/1976 | Youtsey et al. | |
| 4,712,263 A | | 12/1987 | Pronzinski | |
| 4,972,842 A | | 11/1990 | Korten et al. | |
| 5,119,467 A | | 6/1992 | Barsky et al. | |
| 5,285,519 A | | 2/1994 | Barsky et al. | |
| 5,415,618 A | | 5/1995 | Koch | |
| 5,453,077 A | | 9/1995 | Donnelly et al. | |
| 5,498,229 A | | 3/1996 | Barsky et al. | |
| 5,649,896 A | | 7/1997 | Barsky | |
| 5,817,002 A | | 10/1998 | Donnelly et al. | |
| 5,817,003 A | | 10/1998 | Moll et al. | |
| 5,971,914 A | | 10/1999 | Donnelly et al. | |
| 6,036,634 A | | 3/2000 | Goldberg et al. | |
| 6,409,653 B1 | * | 6/2002 | Koch et al. | 600/22 |

FOREIGN PATENT DOCUMENTS

| | | |
|---|---|---|
| DE | 19823495 | 12/1999 |
| EP | 619995 A1 | 10/1994 |
| GB | 1546734 | 5/1979 |
| WO | WO 9848757 | 11/1998 |

* cited by examiner

*Primary Examiner*—John Fox
(74) *Attorney, Agent, or Firm*—Trexler, Bushnell, Giangiorgi, Blackstone & Marr, Ltd.

(57) ABSTRACT

An apparatus for heating an infant including an upper radiant element integrated with the hood and a lower radiant element integrated with the mattress. The upper radiant element comprises a resistive ink printed on the underside of the hood. The mattress is transparent to infra-red wave length radiant energy, and includes a temperature sensor on its topside. The hood includes a liquid crystal panel for controllably viewing the infant, whereas the rest of the hood is opaque.

6 Claims, 4 Drawing Sheets

RADIANT WARMER

This is a divisional of co-pending application Ser. No. 09/802,251, filed on Mar. 8, 2001.

BACKGROUND OF THE INVENTION

1. Field of Invention

The present invention relates to the use of a radiant incubator for infant care.

2. Description of the Prior Art

Neonates, particularly prematurely born infants, require special care for a period after being born. In particular, they require environmental control including tight control over the environmental temperature and also the quality of the air by which they are surrounded. In such circumstances it is typical for the neonate to by treated in an incubator using convection heating or other methods to maintain the ambient air temperature.

There are a number of other methods known in the art for regulating the temperature of the infant. For example, WO 98/48757 discloses the construction of a radiant heating element which can be used in infant radiant warmers of varying type. U.S. Pat. No. 5,817,002 relates to a combination incubator with radiant warmer which is operable in a number of different modes and includes convective heat transfer and heated air curtains in addition to the radiant heating head. U.S. Pat. No. 5,285,519 describes a transparent film radiant heater provided in the form of an incubator hood. U.S. Pat. No. 5,498,229 relates to an infant radiant warmer incorporating transparent film radiant heating panels. U.S. Pat. No. 5,119,467 describes an incubator with clear radiant elements integrated with the hood. U.S. Pat. No. 4,972,842 concentrates on the monitoring of physiological parameters associated with the ventilation of infants during assisted ventilation, as an adjunct it refers to providing a constant temperature environment for the infant using a combination of convective and radiant heating. U.S. Pat. No. 4,712,263 relates to the provision of a bubble-like self-supporting thermal barrier for use with neonatal infants on open radiant warmer beds or in convection warmed infant incubators. EP 619995 appears to show a radiant warmer in which the radiant heating source is divided into two blocks which are spaced apart in the longitudinal direction of the table to which the heating unit is attached. GB 1546734 includes side panels which are raised to "at or about blood heat". It is unlikely that actual radiant heating of the infant is anticipated, rather than the temperature of the convected air is not affected.

To some extent, at least the above examples will be ineffective at accurately regulating the temperature of the infant. Further, in many cases the method used will be inefficient. In the incubatory examples when access is required the infant will often go unheated while being attended to.

SUMMARY OF THE INVENTION

This is an object of the present invention to provide a radiant incubator which goes some way toward overcoming the above-mentioned disadvantages or which will at least provide the health care industry with a useful choice.

Accordingly, in a first aspect the present invention may be broadly said to consist in an apparatus for heating an infant comprising or including:

surface for supporting said infant, cover means configured to extend over said surface and including a portion which may be configured to at least a substantially visually opaque state or a substantially visually transparent state, at least one radiant heating means in proximity with either said cover means or said surface, and control means for energising said at least one radiant heating means such that in use the skin temperature of said infant is regulated within a predetermined range.

In a second aspect the present invention may be broadly said to consist in a mattress configured for use in a neonatal incubator comprising or including:

a flexible support structure being transparent to infra-red wave length radiant energy, and a radiant element being located underneath said flexible support structure including: a housing means having a contact surface for contacting the underside of said flexible support structure; one or more radiant heating elements disposed within the bulk of said housing means in a location spaced from said contact surface; and an infrared radiation barrier means blocking infrared radiation from said elements in directions away from said contact surface; said housing means incorporating infrared transmission means between said elements and at least adjacent regions of said contact surface, and said adjacent regions of said contact surface being infrared transmissible also.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

One preferred form of the present invention will now be described with reference to the accompanying drawings in which.

DETAILED DESCRIPTION OF THE PREFERRED EMBODIMENTS

The present invention provides an efficient system for caring for infants required to be treated in an incubator by providing a thermo-neutral environment. Effectively, a radiant element integrated with the incubator cover, radiates heat energy to the infant at a level which approximately balances with the energy emitted or lost by the infant. Since the environment within the incubator is closed and controlled, ie: minimal conduction or convection losses, the baby's net heat loss will approximately zero. This means that the infant will be able to regulate its temperature effectively without intervention.

Incubator Construction

Figure 1:
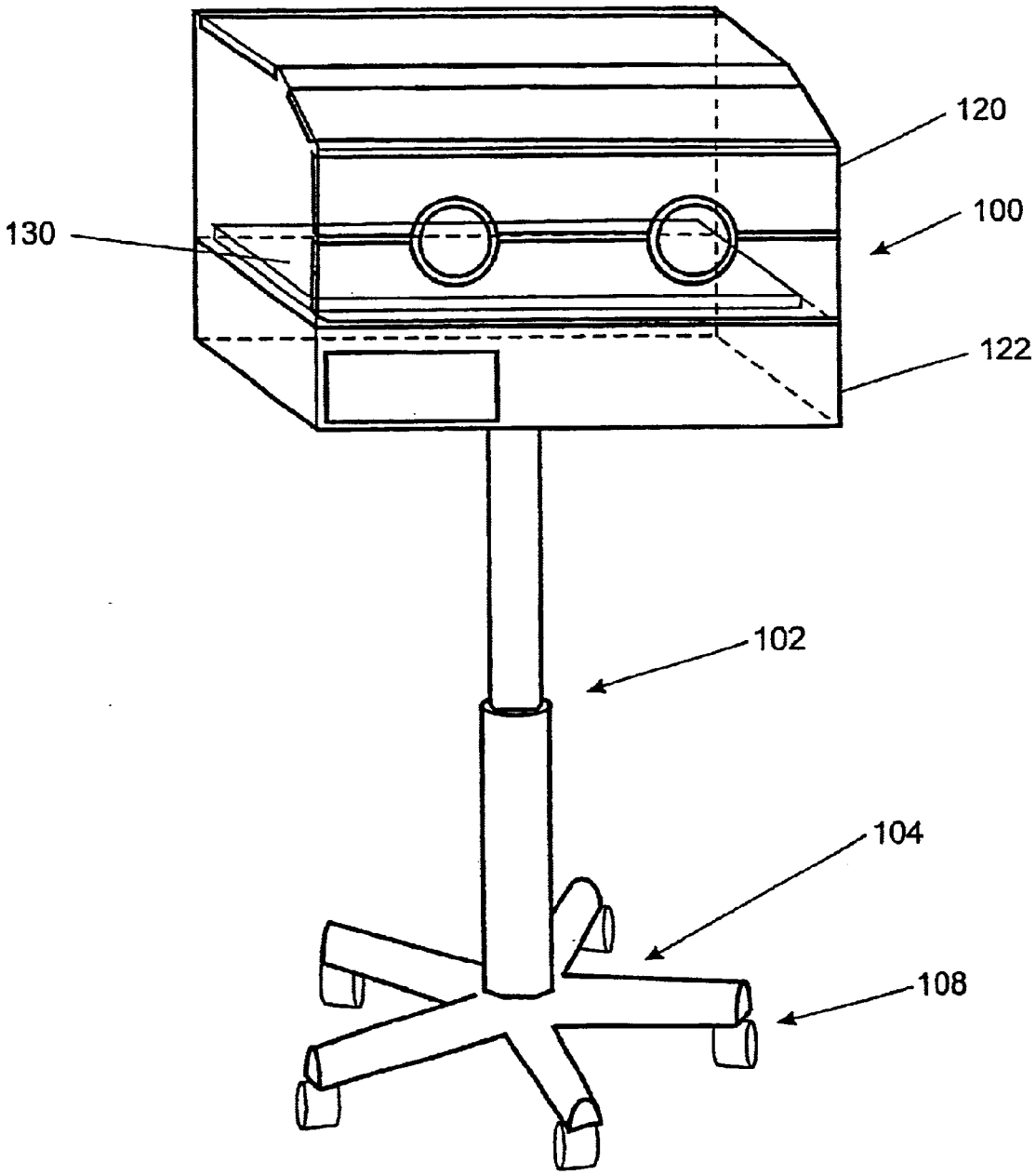
FIG. 1, is a perspective view of the incubator according to the preferred embodiment of the present invention in a closed state.

Referring now to FIG. 1, we see a general perspective view of the incubator 100. The incubator 100 is supported by a column 102 which may be adjusted in height using either automatic electromechanical means or a gas lift system similar to that used in office chairs. At its base 104 the support column 102 includes preferably lockable castor wheels 108 to allow the incubator 100 to be portable and transported around the hospital environment.

The incubator 100 itself is comprised of a cover 120 and a body portion 122 on which the infant is supported. The upper radiant heater element 202 (shown in more detail in FIG. 2) is integrated with the underside of the cover 120 which is configured such that the radiant heat generated thereby is directed substantially at the infant.

Figure 4:
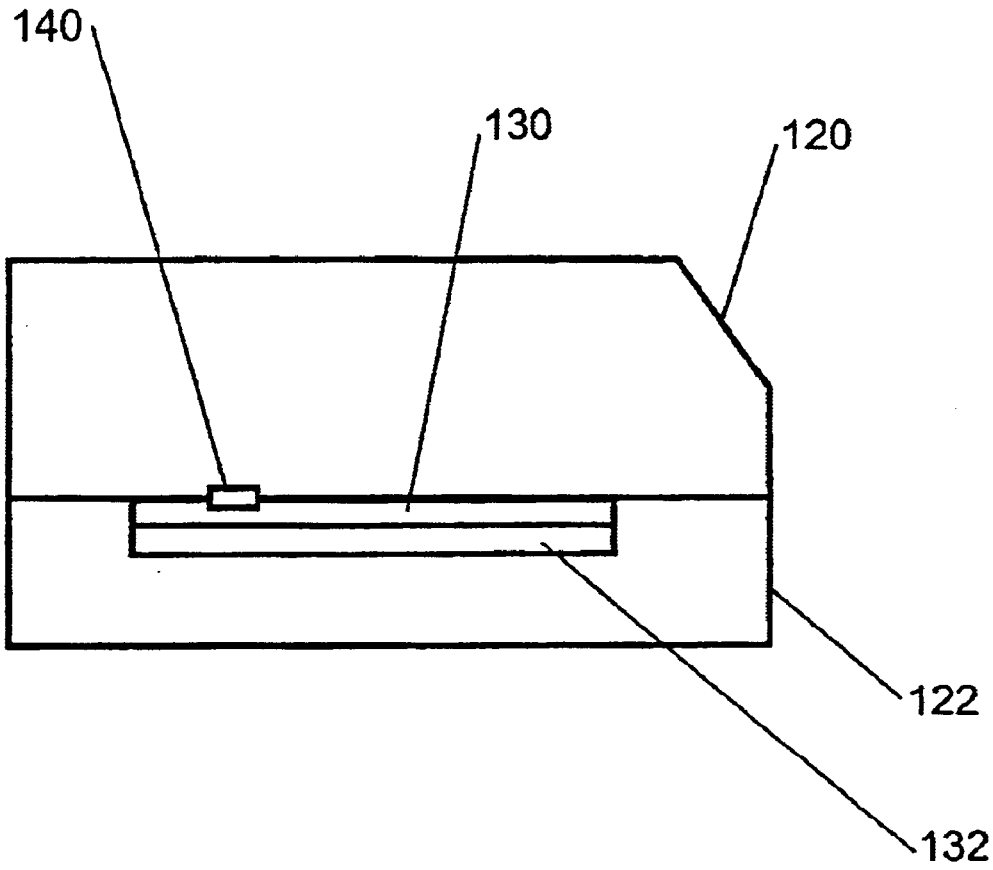
FIG. 4 is a cross-section view of the incubator showing the mattress and lower radiant element.

As well as being radiated by the upper radiant element 202, the infant will also be radiantly heated underneath by way of the heated mattress 130 on which the infant will lie as shown in FIG. 4. The mattress 130 itself in one embodiment of the present invention may comprise an air-filled cushion, or it may also comprise a gel-filled cushion or any other support means as are known in the art. A lower radiant heater element 132 (which will be described later) is positioned directly underneath the mattress 130. The lower radiant element 132 radiates energy using a wavelength in the Infra-red band through the mattress and directed at the infant. In order to achieve this, the mattress 130 must be constructed of a material suitable to transmit infra-red radiation. Clear heat resistant PVC or polythene are suitable for this purpose.

A temperature sensor 140 is also provided on the upper surface of the mattress 130 in order to detect the skin temperature of the infant. This may be a thermistor or any other means of temperature sensing as are known in the art. As will be detailed later, this is used in the control of the radiant elements and also for safety purposes.

Cover Construction

Figure 2:
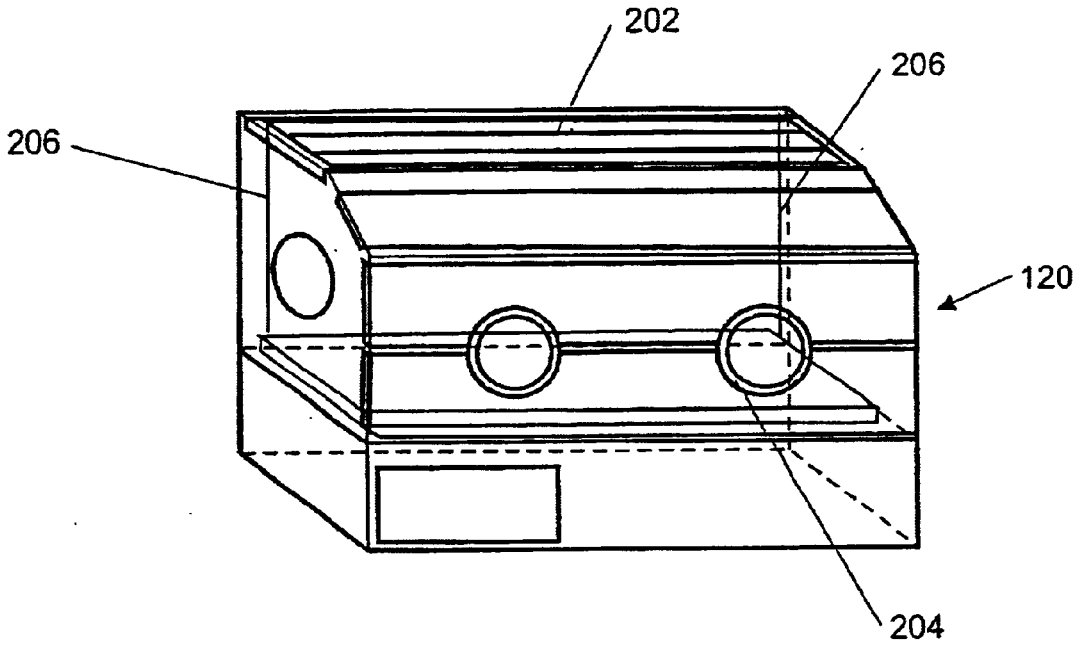
FIG. 2 is a perspective view of the incubator showing the upper radiant element.

Referring now to FIG. 2, in which the incubator cover 120 is seen in more detail. The cover is designed such that in a closed position it will lock down on to the body portion and seal thereon. In this case it will provide a closed environment for the infant, as is required of commercial incubators.

The radiant heater element 202 integrated with the cover may take any one of a number of forms. In the preferred embodiment of the present invention a resistive ink is printed onto the inside surface of the cover similar to that used in the rear windscreen of cars. Each strip of resistive ink will be designed to be as thin and wide as possible in order to ensure the most efficient radiation distribution. Further, a radiation reflector may be provided behind each strip to ensure that all radiation is directed downwards towards the infant and not lost into the surroundings. The resistive ink is connected to a low voltage power source through connection 206, the power source being controlled by the incubator controller (described later). The resistive ink may be protected by an insulating layer or an IR transparent shield.

For access to the infant, two levels of accessibility are provided. Firstly, hand openings 204 are provided in the cover 120. This might be useful for example for a nurse to reattach vital sign sensors or other superficial tasks. In this case the radiant element 202 on the cover 120 heats the baby. In order to get full access to the infant, the entire cover 120 may be removed to completely uncover the infant. The cover itself may lift off completely or alternatively it may swing open. In this case a separate radiant heater either positioned over the baby or the lower radiant heater element under the baby will provide heat.

Cover Darkening

It will be appreciated that in most situations it will be of advantage to provide a darkened environment for the infant. To this end, the cover may be provided with a Liquid Crystal (LC) panel in either a section or the entire cover. Such a panel allows control over whether light is blocked or transmit through the cover. Such panels are readily commercially available and work on the principle of variable polarisation depending on the electrical field applied.

Figure 3:
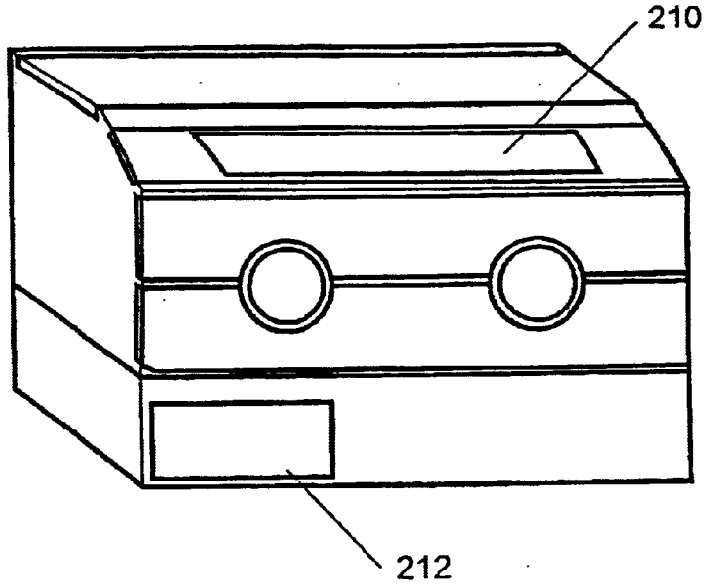
FIG. 3 is a perspective view of the incubator showing the cover darkening system

Referring now to FIG. 3 the cover 120 is illustrated including a LC panel 210 on the angled portion of the cover 120. In this fashion while the remainder of the cover 120 is in this embodiment darkened (tinted or coloured plastic) the panel 210 may be switched between an opaque or transparent state by actuating a button or similar on control panel 212, which in turn energises the panel 210 accordingly. It might also be useful to provide intermediate states, for example to simulate day and night.

Incubator Controller

Both the radiant element in the cover and the heater pad underneath the mattress are optimally controlled in order to provide a thermoneutral environment for the infant. The skin temperature of the infant is monitored in order to ensure that radiant beat energy being supplied to the infant approximates that of the total heat losses of the infant. Also, when the cover is removed and the infant is only heated by the mattress heater pad and/or a separate radiant heater the controller also ensures that as much heat energy is supplied to the infant as possible from the mattress heater pad without any adverse effects to the infant. The result is that the present invention provides a radiant infant incubator which efficiently provides a thermoneutral environment such that the infant may effectively regulate its own temperature without intervention both with the cover closed and with the cover off.

With the cover closed the elements are controlled to result in a infant skin temperature of approximately 37° C. With the cover open the mattress heater pad is controlled such that the infant skin temperature will also be approximately 37° C.

In such circumstances, it might also be desirable to have the air surrounding the infant to be humidified. The present invention provides added advantage in this circumstance since the provision of the radiant element in the cover will prevent condensation occurring thereon and the subsequent problems. If humidification means are to be provided then the interface would most likely also provide control over both the level of humidification and the temperature of the incubator environment. The air within the incubator might also be pressurised and would come from a filtered clean air source.

Lower Radiant Heater Element

Figure 5:
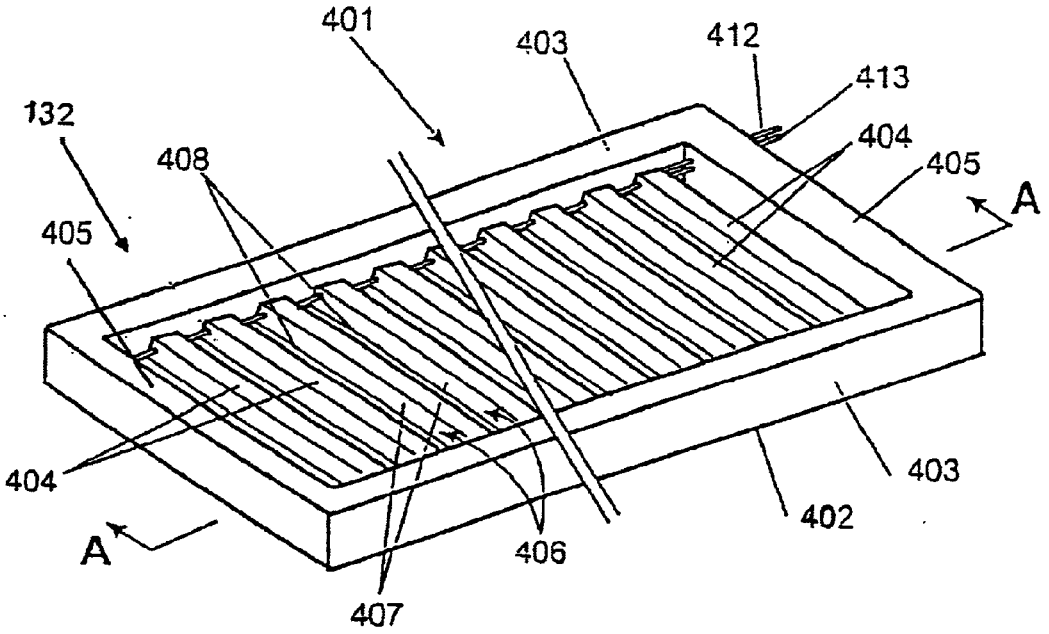
FIG. 5 is a perspective view of the lower radiant element according to the present invention.
Figure 6:
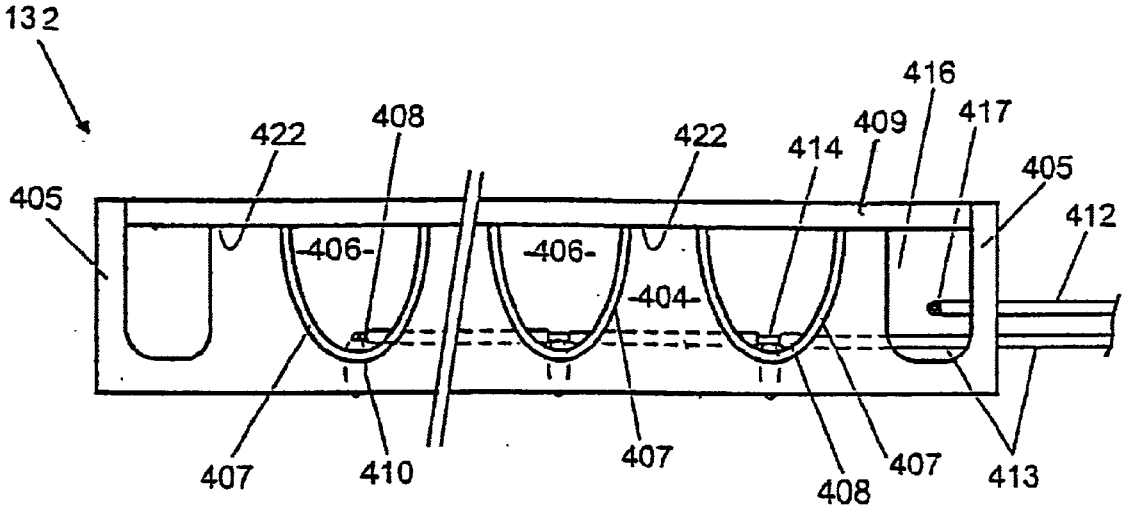
FIG. 6 is a cross section through the lower radiant element of FIG. 5.

Referring to FIGS. 5 and 6, the preferred embodiment of the lower radiant heater element 132 according to the present invention comprises a flexible warming pad 401. The warming pad 401 has a main, flexible, body 402. The body 402 includes a raised periphery formed by sides 403 together with ends 405. Within this periphery are located a series of parallel channels 406. Within each channel 406 is located a radiant heating element 408. The radiant heating elements 408 are connected in parallel by a pair of power supply wires 412, 413 which extend from the pad 401 for connection to a power source. An infrared transparent cover 409, not shown in FIG. 5, encloses the space within the periphery of the main body 402, spanning between the tops 422 of the walls 404 left by the channels 406. Alternatively the cover 409 may only be partially transparent to infrared, the remaining heat energy being transferred through conduction to the infant.

The main body 402 is preferably formed from a soft and flexible material such as a suitable elastomeric material. An example of a suitable material is silicon rubber such as that manufactured and supplied by Dow Coming or thermoplastic polyurethane by Bayer.

With a material such as the Dow Coming silicone rubber, protection is necessary from the local application of radiant energy by the heater elements. An infrared radiation barrier 407 is preferably provided. This infrared radiation barrier may for example comprise a metal foil or woven glass fibre barrier or a deposited ceramic coating such as a mica coating. The infrared radiation barrier is preferably substantially reflective or scatterative of infrared radiation around the chosen wave length and may be silvered or plated with a reflective material to achieve this effect.

The channels 406 in the main body 402 are preferably shaped having a curved, for example, substantially parabolic, profile such that radiation reflected by the infrared barrier is substantially evenly distributed upon exiting the channels.

The heater wires 408 preferably lay along the bottom of each channel 406 and are secured in place, for example, by zig zag stitching 410 through the gel main body 402. Electrical supply to the resistive wires 408 is typically at a low voltage (eg 8 v) and consequently a metallic thread of low conductivity can be used for the zig zag stitching 410 without significant power conduction thereby. As one possible alternative ceramic beads formed around the wire and bonded to or moulded into the elastomeric material may support each wire.

The resistive wires 408 are connected in parallel (or parallel series combination) by the supply wires 412, 413. The supply wires 412, 413 are preferably of a substantially lower resistance material, for example, copper and given the high load that they will carry are of preferably a larger gauge than the resistive wires 408. The supply wires 412, 413 preferably extend the length of the pad 402 passing through each of the walls 404 separating the channels 406. The resistive wires 408 are connected to the supply wires 412, 413 at non insulated positions 414 there along. The wires 412, 413 are preferably provided exiting the pad 402 at a single convenient location and consequently are required to traverse the width of the pad 402 this traverse may occur within the final channel 416 (see FIG. 6), for example such as indicated by traversing section 417 of conductive supply wire 412.

The radiant heating elements 408 are of comparatively high resistance and the material thereof is selected to provide infrared radiation in a frequency band which is readily absorbed over certain depth by human flesh or water. Radiation in the infrared A & B spectrums is appropriate in this case. Given that blood is substantially composed of water this ensures that radiation from the pad 401 is at least absorbed by the blood stream of the patient having been partially transmitted through the skin of the patient without significant heating of the skin. Radiation absorbed by the skin is absorbed over the fill depth of penetration allowing significantly greater total heat input per unit volume than is achievable by conductive or convective heating, where all heat must pass through at least the outer layer, for the same effect on skin temperature. An example of suitable wire is Nickel Chromium eg: 80/20 or 60/40 and typically of a gauge of 24 B&S, 40 B&S 25SWG or 44SWG.

The infrared transparent film 409 is preferably secured to the gel main body 402 along the top 422 of each wall 404 between channels 406. This connection may for example be by an adhesive such as contact glue, or over moulded or welded. The cover 409 may for example comprise an infrared transparent film such as a polyethylene based film.

It will be appreciated that what has been described above is an improved neonatal incubator, with a number of advantages over the prior art. Firstly it uses radiant elements to heat the infant, as opposed to other ineffective and inefficient methods such as convection or conduction. Secondly it is controlled to counterbalance radiant heat losses. Thirdly, it allows unimpeded access to the infant, whilst still heating the infant. This is of significant advantage, as some treatment may extend for a significant period—where otherwise the baby would cool with the subsequent ill effects. Lastly it provides a darkened environment which can be controlled to allow visual inspection of the infant.

What is claimed is:

1. An apparatus configured for use in a neonatal incubator comprising:

a flexible support structure being transparent to infra-red wave length radiant energy, and a radiant element located underneath said flexible support structure and comprising a housing including a contact surface for contacting the underside of said flexible support structure, one or more radiant heating elements disposed within said housing in a location spaced from said contact surface, and an infrared radiation barrier means for blocking infrared radiation from said one or more radiant heating elements in directions away from said contact surface; said housing incorporating infrared transmission medium between said one or more radiant heating elements and regions of said contact surface which are adjacent said infrared transmission medium, said regions of said contact surface being infrared transmissible.

2. An apparatus as claimed in claim 1 wherein said flexible support structure comprises an gas filled cushion.

3. An apparatus as claimed in claim 2 wherein said gas filled cushion is constructed from clear PVC.

4. An apparatus as claimed in claim 2 wherein said gas filled cushion is constructed from clear Polythene.

5. An apparatus as claimed in claim 1 wherein said flexible support structure comprises a gel-filled cushion.

6. An apparatus as claimed in any one of claims 1 to 3 further comprising temperature sensing means on the upper side of said flexible support structure for sensing the skin temperature of a neonate in use supported on said flexible support structure.

* * * * *

UNITED STATES PATENT AND TRADEMARK OFFICE

CERTIFICATE OF CORRECTION

PATENT NO. : 6,673,007 B2 
DATED : January 6, 2004
INVENTOR(S) : Andrew Paul Maxwell Salmon and Matthew Jon Payton It is certified that error appears in the above-identified patent and that said Letters Patent is hereby corrected as shown below:

Column 4,
Line 23, “beat” should read -- heat --

Column 5,
Lines 4 and 6, “Dow Coming” should read -- Dow Corning --
Line 57, “fill” should read -- full --

Signed and Sealed this

Thirteenth Day of April, 2004

JON W. DUDAS
*Acting Director of the United States Patent and Trademark Office*